US005858093A

United States Patent [19]

Saitoh et al.

[11] Patent Number: 5,858,093

[45] Date of Patent: Jan. 12, 1999

[54] LIQUID APPLYING MEMBER AND A TOOL FOR MANUFACTURING THAT MEMBER

[75] Inventors: Masatoshi Saitoh; Hidenori Tomono; Kunio Hibi; Kazuo Akita, all of Tokyo, Japan

[73] Assignee: Ricoh Company, Ltd., Tokyo, Japan

[21] Appl. No.: 724,007

[22] Filed: Sep. 30, 1996

[30] Foreign Application Priority Data

Sep. 30, 1995 [JP] Japan ..... 7-276370

[51] Int. Cl.[6] ..... B05C 1/00

[52] U.S. Cl. ..... 118/212; 118/236; 118/258; 118/60; 118/66; 118/101; 118/106

[58] Field of Search ..... 118/60, 66, 101, 118/106, 212, 236, 258

[56] References Cited

U.S. PATENT DOCUMENTS 5,463,447 10/1995 Kurotori et al. .

FOREIGN PATENT DOCUMENTS 60-230899 11/1985 Japan .
3-068460 3/1991 Japan .

OTHER PUBLICATIONS

Kirk–Othmer, Encyclopedia of Chemical Technology, 3rd Edition, vol. 6, "Coating Processes", 1979.
Patent Abstracts of Japan, JP–A–01 297294, Nov. 30, 1989.
Patent Abstracts of Japan, JP–A–02 055195, Feb. 23, 1990.
Patent Abstracts of Japan, JP–A–04 064472, Feb. 28, 1992.
Patent Abstracts of Japan, JP–A–04 064473, Feb. 28, 1992.
Patent Abstracts of Japan, JP–A–04 067043, Mar. 3, 1992.
Patent Abstracts of Japan, JP–A–05 173454, Jul. 13, 1993.
Patent Abstracts of Japan, JP–A–05 216374, Aug. 27, 1993.
Patent Abstracts of Japan, JP–A–04 082983, Mar. 16, 1992.
Patent Abstracts of Japan, JP–A–04 033088, Nov. 20, 1992.
Patent Abstracts of Japan, JP–A–07 098513, Apr. 11, 1995.
Patent Abstracts of Japan, JP–A–07 121073, May 12, 1995.
Patent Abstracts of Japan, JP–A–07 134524, May 23, 1995.
Patent Abstracts of Japan, JP–A–07 199756, Aug. 4, 1995 (With partial English translation).
Patent Abstracts of Japan, JP–A–07 199757, Aug. 4, 1995 (With partial English translation).
Patent Abstracts of Japan, JP–A–04 089271, Mar. 23, 1992.
Patent Abstracts of Japan, JP–A–06 089068, Mar. 29, 1994.
Patent Abstracts of Japan, JP–A–07 056470, Mar. 3, 1995.
Patent Abstracts of Japan, JP–A–61 213185, Sep. 22, 1986.

*Primary Examiner*—Laura Edwards
*Attorney, Agent, or Firm*—Oblon, Spivak, McClelland, Maier & Neustadt, P.C.

[57] ABSTRACT

A liquid applying member and a tool are provided. The liquid applying member includes an applying roller which can stably apply an unstabilizing liquid to a transfer paper. The tool is referable for manufacturing the applying roller. A large number of recess portions independent from each other are provided on a circular circumferential surface of the applying roller for applying the unstabilizing liquid which unstabilizes an attachment state between the toner and the transfer paper to the transfer paper having a toner image formed thereon. The recess portion can be formed by pressing the rotating tool constructed with a roller member made of a material harder than that of the surface portion of the applying roller and provided with projecting portions formed on a circular circumferential surface thereof, so as to engage with the recess portions having a target shape of the applying roller to the raw material of the applying roller.

10 Claims, 6 Drawing Sheets

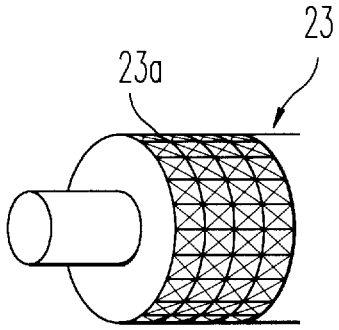
FIG. 2A
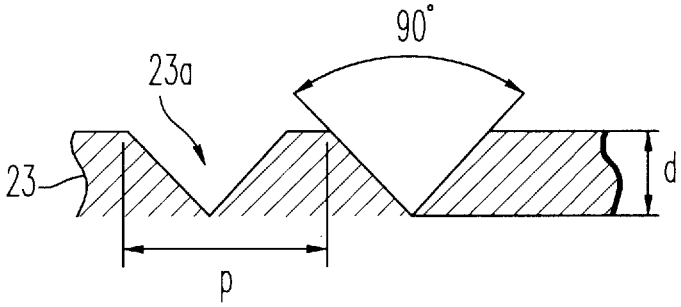
FIG. 2B
FIG. 3A
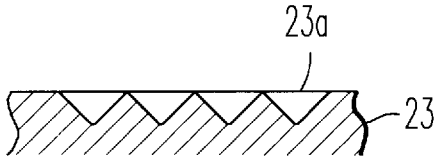
FIG. 3B
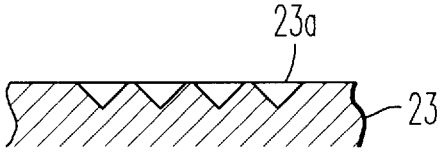
FIG. 3C
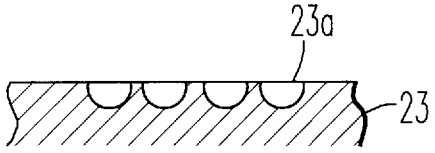
FIG. 3D
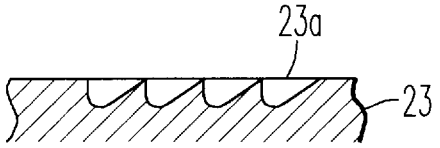

LIQUID APPLYING MEMBER AND A TOOL FOR MANUFACTURING THAT MEMBER

BACKGROUND OF THE INVENTION

1. Field of the Invention

The present invention relates to a liquid applying member of an image forming substance removing apparatus, in particular, a liquid applying member for applying an unstabilizing liquid, which makes unstable the attaching state between an image forming substance and an image carrier, onto an image carrier in a reproducing apparatus for reproducing the image carrier, which removes the image forming substance from the image carrier having an image made of the image forming substance formed on the surface thereof constructed with fiber material.

2. Description of the Related Art

Conventionally, from the viewpoint of effective utilization of natural resources, there have been proposed heretofore various sorts of reproducing methods of reproducing the image carrier by removing the image forming substance from the image carrier in order to reuse the image carrier and various sorts of apparatuses for accomplishing the above.

As to such technologies, for instance, refer to the published specifications of Japanese Laid-open Patent publication Nos. 1-10157/1989, 2-55195/1990, 4-4472/1992, 4-82983/1992, and 4-300395/1992.

In particular, in order to remove only the image forming substance without comparatively damaging the image carrier, the present applicant has already proposed a method of and an apparatus for holding on the image carrier at least one sort of water or water solution selected from the group consisting of water solution containing water, water solution containing surface active agent, water solution containing water-soluble polymer, and water solution containing surface active agent and water-soluble polymer as an unstabilizing liquid; heating the image forming substance on the image carrier so as to fuse or soften that substance; bringing a peeling-off member capable of demonstrating a sticking force larger than the sticking force between the image carrier and the image forming substance into contact with the image carrier; and peeling off and removing the image forming substance from the image carrier when the peeling-off member is separated from the image carrier. (For instance, refer to Japanese Patent Application No. 4-25591/1992 and Japanese Patent Application No. 5-239075/1993.)

Furthermore, although there exist some methods of employing a roller-shaped liquid applying member, dipping into the solution, and non-contact applying by use of the ink jet, etc., as a method of applying the unstabilizing liquid, the above-mentioned methods of employing a liquid applying member are profitable from the viewpoints of design margin, cost reduction, quality stabilizing, etc.

Hereupon, the amount of applying the unstabilizing liquid needed for reproducing the above-mentioned image carrier differs in accordance with the sort of the image carrier, the sort of the unstabilizing liquid, and the condition at the time of the peeling-off treatment; and further the amount varies in the wide range of 1%–50% of the image carrier's weight. For instance, since weight of general paper is about 5 g, the amount of applied unstabilizing liquid needed for reproducing the general (ordinary) paper of A4 size varies widely in the range of 0.05 g–2.5 g.

In such a way, since the amount of the applied unstabilizing liquid needed for the purpose varies in a wide range, there was a fear of impossibility of applying a needed amount of the unstabilizing liquid depending on the sort of the image carrier in the case of employing the above-mentioned roller-shaped liquid applying member.

In such a situation, conventionally, there was a proposal of making the circumferential velocity of the liquid applying member larger than the transporting speed of the image carrier, for instance, by raising the rotation speed of the liquid applying member, in order to increase the amount of applying of the liquid by use of the above roller-shaped liquid applying member. (For instance, refer to the contents of the above described published specification of the Japanese Laid-open Patent Publication No. 7-92667/1995.)

On the other hand, there is a fear of causing a problem in that, when the rotation speed of the liquid applying member is raised up as mentioned before, the rear edge portion of the image carrier is rapidly transported and thereby the image carrier is broken and paper jamming occurs, and further the liquid applying amount becomes insufficient contrary to the initial aim.

SUMMARY OF THE INVENTION

The present invention has been made in consideration of the above-mentioned actual circumstances and drawbacks to be solved.

It is an object of the present invention to solve the points at issue as mentioned heretofore.

It is another object of the present invention to enable a stable application of the unstabilizing liquid necessary for reproducing the image carrier even in the case of making the circumferential speed of the image carrier equal to the transporting speed thereof.

It is still another object of the present invention to provide for a liquid applying member which is capable of stably applying the unstabilizing liquid necessary for reproducing the image carrier and a tool or instrument referable for manufacturing the member even in the case of making the circumferential speed of the image carrier equal to the transporting speed thereof.

It is still another object of the present invention to provide a tool or instrument referable for manufacturing the above-mentioned liquid applying member.

In order to attain the above-mentioned objects, a first invention is characterized in that a liquid applying member is formed in a state of a roller for applying an unstabilizing liquid onto an image carrier having an image formed on the surface of the image carrier made of am image forming substance, wherein the unstabilizing liquid is applied onto the image carrier for the purpose of making unstable the attaching state between the image forming substance and the image carrier, and wherein a large number of recess portions independent from each other are provided on a circular circumferential surface of the liquid applying member.

A second invention is characterized in that a tool or instrument is employed for manufacturing the liquid applying member of the first invention, wherein the above tool is constructed with a roller member made of a material harder than that of the surface portion of the liquid applying member, and wherein projecting portions are provided on the circular circumferential surface of the roller member such that the projecting portions are engaged with the recess portions formed in a state of a target shape on the liquid applying member.

A third invention is characterized in that, in the tool or instrument of the second invention employed for manufacturing the liquid applying member of the first invention, wherein the projecting portions are provided on the circular circumferential surface of the roller member such that the circular circumferential surface remains on the roller member.

In the first invention, the unstabilizing liquid is held in the recess portion formed on the surface of the roller-state liquid applying member, and the unstabilizing liquid held in the liquid applying member is brought into contact with the image carrier. Then, the liquid applying member is rotated and thereby the unstabilizing liquid is applied to the image carrier.

Hereupon, since the amount of the unstabilizing liquid held in the recess portion on the surface of the liquid applying member is larger than that of the unstabilizing liquid held in the other portion on the circular circumferential surface thereof, the amount of the unstabilizing liquid held on the surface of the liquid applying member is almost decided in accordance with the shape and size (for instance, "deth") of the above recess portion.

Consequently, if the shape and size of the recess portion of the liquid applying member are previously set so as to enable to hold the unstabilizing liquid of the amount necessary for reproducing the image carrier, it is possible to stably apply the unstabilizing liquid of the necessary amount to the image carrier.

Furthermore, since the above respective recess portions are formed independently from each other, there arises no fear that the unstabilizing liquid held once flows down along the groove before applying the liquid as in the case of forming the continuous groove such as the spiral groove, mesh-like groove, or the like.

In the second invention, the tool or instrument provided with a projecting portion so as to engage the recess portion of the target shape on the surface of the liquid applying member on the circular circumferential surface of the roller-state member made of the material harder than the surface portion of the liquid applying member is pressurizedly pressed to the roller-state raw material of the liquid applying member, and the projecting portion of the tool eats into the surface of the raw material. The raw material or the tool is rotated in a state of fixing the position of the central axis and thereby the projecting portion on the tool is transferringly processed for the surface of the raw material and thereby the recess portion of the target shape can be formed.

Hereupon, in case that the projecting portion is not formed on the circular circumferential surface of the tool so as to oppose the entire area employed for applying the liquid to the circular circumferential surface of the liquid applying member, the above-mentioned roller-state raw material or the tool is moved in the center axis direction in a state of pressurizedly pressing and rotating, and thereby the above-mentioned recess portion can be formed on all of the portions employed for applying the liquid to the circular circumferential surface of the raw material.

In the third invention, when the tool or instrument is brought into pressurized contact with the roller-state raw material of the liquid applying member, and the raw material or the tool is rotated, the recess portion is formed by causing the projecting portion of the tool to eat into the surface of the raw material in a state of bringing the circular circumferential surface remaining on the surface of the tool into pressurized contact with the outer circumferential surface of the raw material.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 2*a* is a partial perspective view of the above applying roller, and FIG. 2*b* is a cross sectional view of the recess portions of the above applying roller;

FIGS. 3*a* through 3*d* are cross sectional views of the recess portions of the applying roller of a modification according to the present invention;

DESCRIPTION OF THE PREFERRED EMBODIMENTS

Figure 1:
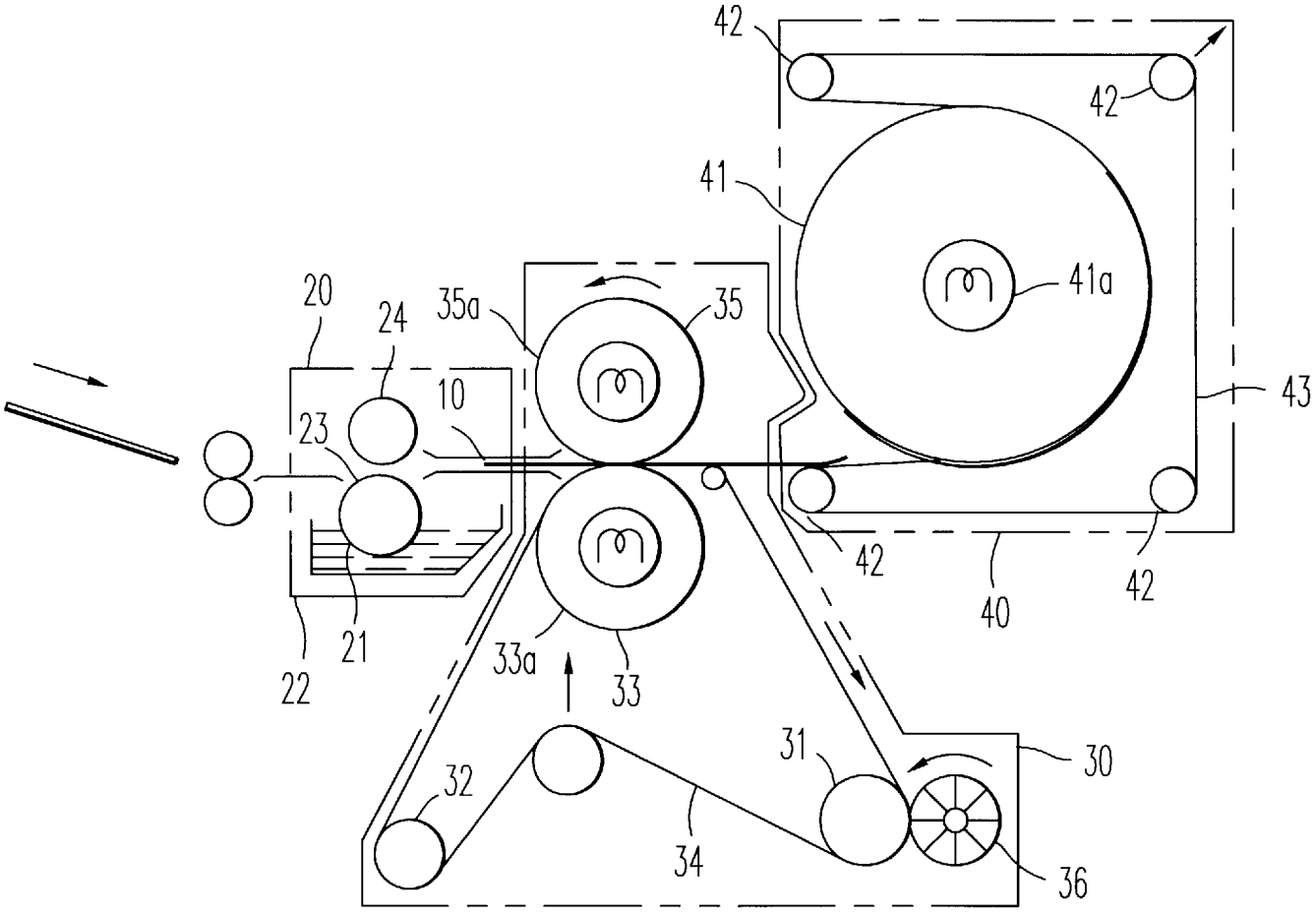
FIG. 1 is an outlined structural view of an apparatus for reproducing an image carrier capable of employing a liquid applying roller of an embodiment according to the present invention.

Referring now to the drawings, wherein like reference numerals designate identical or corresponding arts throughout the several views, the present invention will be described below with reference to referred embodiments in which the invention is applied to a liquid applying member for use in a reproducing apparatus for an image carrier.

Referring first to FIG. 1, a constitutional example of the above reproducing apparatus is described. This reproducing apparatus is provided as an example of a device for peeling off a toner image from a transfer paper as an image carrier on which the toner image is formed by use of a transfer-type electrophotograhic copying machine. The reproducing apparatus for the image carrier according to the present invention is not limited to the device shown in FIG. 1.

In FIG. 1, the reproducing apparatus comprises a liquid supplying unit 20 employed as a medium for supplying an unstabilizing liquid 21 to a transfer paper 10. The transfer paper 10 is fed from a paper feeding unit not shown in FIG. 1 containing stacked transfer paper for separately feeding sheet by sheet the transfer paper 10 on which the toner image is formed. The reproducing apparatus also comprises a toner peeling-off unit 30 including a peeling-off medium for peeling-off toner from the transfer paper 10 to which the unstabilizing liquid 21 is applied, and a drying unit 40 for drying the transfer paper 10 from which the toner is removed and ejecting the dried transfer paper 10 to a paper tray unit which is not shown in FIG. 1.

In the above reproducing apparatus, the paper feeding unit feeds the transfer paper 10 to the liquid supplying unit 20 in a state that a surface including the toner image (hereinafter, called "a toner image surface") faces downward. At this time, the paper feeding unit separates plural fed transfer papers 10 and thereby only one of them is sent out to the liquid supplying unit 20. A concrete constitution and operation of the feeding unit are the same as those of the feeding mechanism in electrophotograhic copying machines, and therefore, the detailed description thereof is omitted here.

The above liquid supplying unit 20 is provided to supply the unstabilizing liquid 21 such as a water solution including water or a surface active agent to the transfer paper 10 so as to enhance a penetration property (permeability) to the transfer paper 10. In the embodiment which is shown in FIG. 1, the liquid supplying unit comprises a liquid container 22 for containing a liquid 21, an applying roller 23 as a liquid applying member which is set so as to be partially sunk in the liquid 21 in the liquid container 22 for supplying the liquid 21 to a toner image surface of the transfer paper 10 by drawing up the liquid 21 by the action of rotation, and a carrying roller 24 facing the applying roller 23 in a state of being separated from each other so as to hold the paper conveying path therebetween. The applying roller 23 is described later in detail.

The toner peeling-off unit 30 comprises a plurality of belt supporting rollers (hereinafter, called "supporting rollers") 31 and 32, a toner offset belt 34 (hereinafter, called "an offset belt") as a peeling-off medium having a form of a belt suspended around a heating roller 33 containing a heating lamp 33*a* as a heating medium, a pressing roller 35 containing a heating lamp 35*a* as a grasping medium disposed so as to be brought into pressurized contact with the heating roller 33 such that the offset belt 34 is put between both of the rollers 33 and 35, and a rotating brush roller 3 for removing toner from a surface of the offset belt 34. At least the surface of the offset belt 34 is made of a material having a greater adhesive force to the softened toner than an adhesive force between the surface of the transfer paper 10 and the toner. For example, the belt itself can be made of aluminum, copper, nickel, or other metallic materials or macromolecular materials such as polyethylene terephthalate (PET) with titanium oxide dispersed. Therefore, in this embodiment, the offset belt 34 is formed by using a 100 $\mu$m thick polyethylene terephthalate (PET) film.

The above heating roller 33 and the pressing roller 35 are provided so as to put the toner image surface of the transfer paper 10 in direct contact with the offset belt 34 and to soften the toner attached to the transfer paper 10 by heating.

In addition, the above rotating brush roller 36 has a constitution such that toner attached to the offset belt 34 is removed by exerting an intermittent scratching force on a circumferential surface of the offset belt 34.

The above drying unit 40, which is used to dry the transfer paper 10 so that a liquid holding amount of the transfer paper 10 is 10% or less of the paper weight, comprises a heating drum 41 made of, for example, an aluminum containing a heating lam 41*a* and a paper pressing belt 43 suspended around plural supporting rollers 42 and moving endlessly in a state that it is wound around a circumferential surface of the heating drum 41 by a certain angle. A tension of the paper pressing belt 43 is adjusted by moving one of the supporting rollers 42 in a direction indicated by an arrow in FIG. 1. For materials of the paper pressing belt 43, materials having a heat-proof property or air permeability such as, for example, canvas, cotton, and polyethylene terephthalate (teflon) cloths can be used.

In the above constitution, the transfer paper 10 on which a toner image is formed by a normal PPC coping machine (for example, an FT2200 manufactured by Ricoh) is fed by the feeding unit not shown in FIG. 1 in a state that the toner image surface thereof faces downward. The unstabilizing liquid 21 is applied to the toner image surface uniformly by the liquid supplying unit 20, the unstabilizing liquid 21 penetrates into an interfacial (boundary surface) portion between the toner and the transfer paper 10, and an attachment state of the toner is unstabilized. Then, the transfer paper 10 is transported to the toner peeling-off unit 30 in a state of retaining the supplied unstabilizing liquid 21. Next, in the toner peeling-off unit 30, the toner firmly sticking to the transfer paper 10 is softened by the heating roller 33 and the pressing roller 35 and attached to a surface of the offset belt 34. When the transfer paper 10 is separated from the offset belt 34 at an end of the heating roller 33, the toner attached to the surface of the offset belt 34 is peeled off from the transfer paper 10, and thereby the toner is removed from the transfer paper 10. The transfer paper 10 from which the toner is removed is separated from the pressing roller 33 by a separation claw and transported to the drying unit 40. The transfer paper 10 transported to the drying unit 40 is dried, and then ejected to the paper tray unit not shown in FIG. 1. Thereafter, the same liquid supplying and toner peeling-off processes are repeated.

Next, the applying roller 23 used as a liquid applying member for applying the unstabilizing liquid 21 to the transfer paper 10 in the above reproducing apparatus is explained hereinafter. The applying roller 23 used in this embodiment has a large number of independent recess portions 23*a* each having a form of a quadrangular pyramid on its circular circumferential surface as shown in FIGS. 2*a* and 2*b*. A pitch p and a depth d of the recess portions 23*a* are previously set in accordance with a target applying amount.

The surface form of the recess portions 23*a* is not limited to the above described quadrangular pyramid, but various forms can be employed as shown in the cross sectional views in FIGS. 3*a* to 3*d*. For example, FIG. 3*a* shows an example of recess portions 23*a* each having a form of a pyramid such as a triangular or quadrangular pyramid without almost any plane surface. FIG. 3*b* shows an example of pyramidal recess portions 23*a* with a plane surface. FIG. 3*c* shows an example of hemispherical recess portions 23*a*, and FIG. 3*d* shows an example of recess portions 23*a* each having a form of a bucket in a water wheel such that an oval surface is inclined. In addition, the above various recess portions 23*a* are permitted to be arranged in a lattice pattern or a hound's tooth (zigzag) pattern on the circular circumferential surface of the applying roller 23, and this arrangement is also not limited. To apply the unstabilizing liquid 21 uniformly to the transfer paper 10, it is preferable to arrange the recess portions 23*a* uniformly on the circular circumferential surface of the applying roller 23.

Figure 4A:
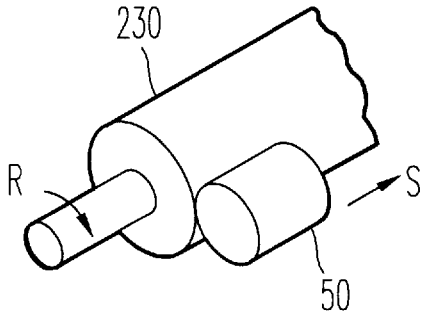
FIG. 4*a* is a persective view of the applying roller and a rotating tool at the time of mechanically processing the applying roller.
Figure 4B:
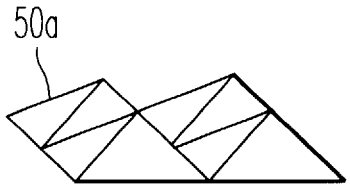
FIG. 4*b* is a partial cross sectional view of the projecting portion of the rotating tool.
Figure 5A:
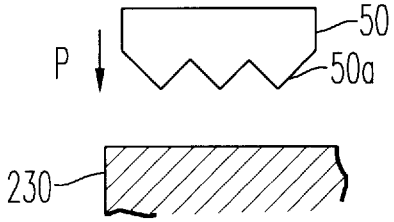
FIGS. 5*a* and 5*b* are, respectively, cross sectional views of the applying roller before and after the mechanical processing thereof.
Figure 5B:
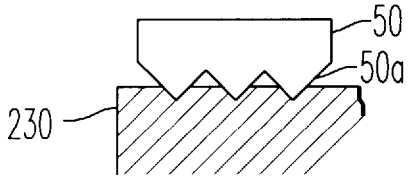

FIGS. 4*a*, 4*b*, 5*a*, and 5*b* show examples of a process method of forming the above-described recess portions 23*a* on the applying roller 23. There is provided a rotating tool 50 (a kind of a diagonal-line knurl roller) which has projecting portions 50*a* in the form of quadrangular pyramids (See FIG. 4*b*) on its surface, such that they are engaged with the recess portions 23*a* of the target shape based on JIS-B0951 on a circular circumferential surface of a roller member made of a material harder than that of the surface portion of the applying roller 23 (for example, Al or other metals). The rotating tool 50 is moved in a direction indicated by an arrow S along a rotating shaft in a state of being pressed in a direction indicated by an arrow P to a circular circumferential surface of a raw material 230 in the form of a roller which is a material of the applying roller 23 as shown in FIG. 5*a*. At this time, the raw material 230 is revolutionally driven in a direction indicated by an arrow R to subsequently move the rotating tool 50 coupled with the rotating raw material. In this method, the applying roller 23 having a target shape of recess portions 23*a* can be easily obtained by performing a transfer process (plastic process) such as transferring a shape of the projecting portions 50*a* of the rotating tool 50 onto the entire circular circumferential surface of the raw material 230 as shown in FIG. 5*b*. The projecting portions 50*a* on the above rotating tool 50 need not be formed in a plurality of rows in an axial direction, but it is permitted to have a single row.

Furthermore, as a method of forming recess portions 23*a* on the circular circumferential surface of the above applying roller 23, it is also possible to employ an etching method used for manufacturing a conventional gravure roller for gravure printing. This etching method, however, has disadvantages in that it requires intricate processing procedures such as (1) coating photosensitive solution, (2) drying by heat, (3) exposing with a photomask, (4) developing and removing the photosensitive agent with the solution on the unexposed portions (reinforcing a photosensitive film, if necessary), (5) etching bite (corroding with the solution), and (6) removing the photosensitive agent. Further, the etching method requires a technical management on processing the recess portions (slot), in other words, skills and know-how for a management of a shape of the recess portions (groove), in addition to a higher processing cost. From these points of view, the above-mentioned processing method according to the embodiment shown in FIGS. 4*a*, 4*b* is more advantageous than the etching method.

Figure 6:
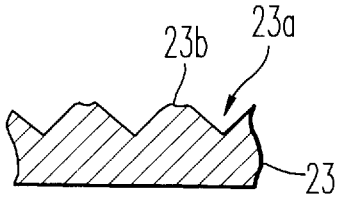
FIG. 6 is an explanatory view of a changed portion of the applying roller's surface.
Figure 7A:
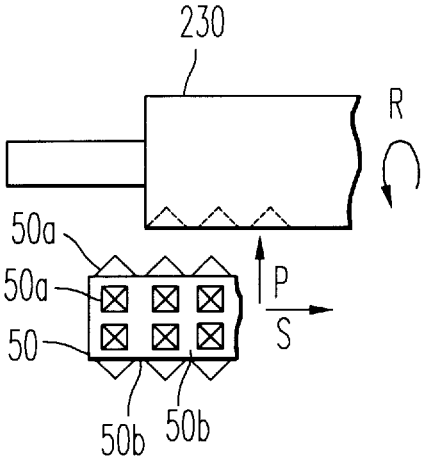
FIG. 7*a* is a side view of the applying roller and the rotating tool according to a modification of the present invention at the time of mechanically processing the applying roller.
Figure 7B:
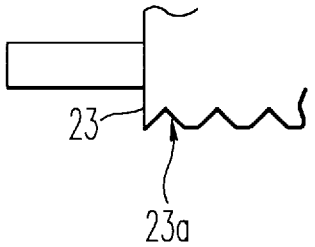
FIG. 7*b* is a partial side view of the applying roller after mechanical processing.

When the recess portions 23*a* are formed on the applying roller 23 by using the above rotating tool 50, there arises a fear that deformed portions 23*b* may be created on the circular circumferential surface of the applying roller 23 as shown in FIG. 6. Therefore, it is preferable to form the projecting portions 50*a* of the above rotating tool 50 such that the circular circumferential surface 50*b* remains as shown in FIG. 7*a*. The recess portions 23*a* can be formed as shown in FIG. 7*b* by revolving the rotating tool 50 in a direction indicated by an arrow R in a state of pressing it to the raw material 230 of the applying roller 23 (in a direction indicated by an arrow P) and moving the rotating tool 50 in a direction indicated by an arrow S. At this time, the recess portions 23*a* are formed by making the projecting portions 50*a* of the rotating tool 50 bite (eat into) the surface of the raw material 230 in a state that the circular circumferential surface 50*b* between the projecting portions 50*a* of the above rotating tool 50 is pressed so as to be brought into contact with the outer peripheral surface of the above raw material 230. Therefore, the recess portions 23*a* in a fixed shape can be formed, while an outer peripheral surface having a uniform radius is obtained without creating the deformed portions 23*b* as shown in FIG. 6 on the outer peripheral surface of the raw material 230.

Figure 8A:
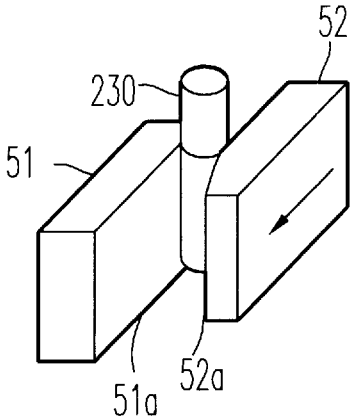
FIGS. 8*a* and 8*b* are, respectively, explanatory views of mechanically processing the applying roller according to the modification of the present invention.
Figure 8B:
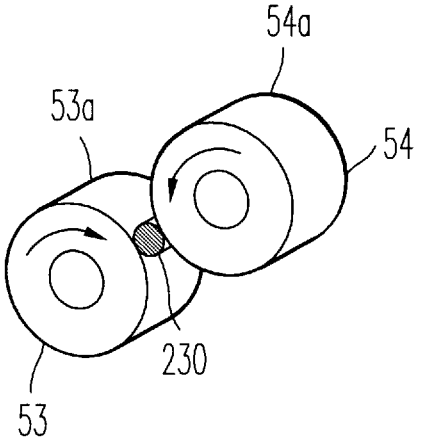

Furthermore, as to the processing method of the recess portions 23*a* of the above applying roller 23, it is also permitted to employ the above-described etching method or cutting/grinding processing methods, in addition to the above-mentioned method of pressing the rotating tool 50 to the raw material 230 as shown in FIGS. 4, 5, and 7. Furthermore, it is permitted to employ a processing method used for thread rolling as shown in FIGS. 8*a* and 8*b*. In FIG. 8(*a*), the recess portions can be formed on the circular circumferential surface of the raw material 230 by moving a flat die 52 in a direction indicated by an arrow in a state that the raw material 230 is put between a flat die 51 and the flat die 52 whose facing surfaces 51*a* and 52*a* have the projecting portions as mentioned above. In FIG. 8*b*, the recess portions can be formed on the circular circumferential surface of the raw material 230 by rotating round dies in the directions indicated by arrows in a state that the raw material 230 is put between the round dies 53 and 54 whose circular circumferential surfaces 53*a* and 54*a* have the projecting portions as mentioned above.

A result of an experiment in applying the above unstabilizing liquid 21 to the transfer paper by using the above-mentioned applying roller 23 shown in FIG. 2 is described hereinafter.

Figure 9:
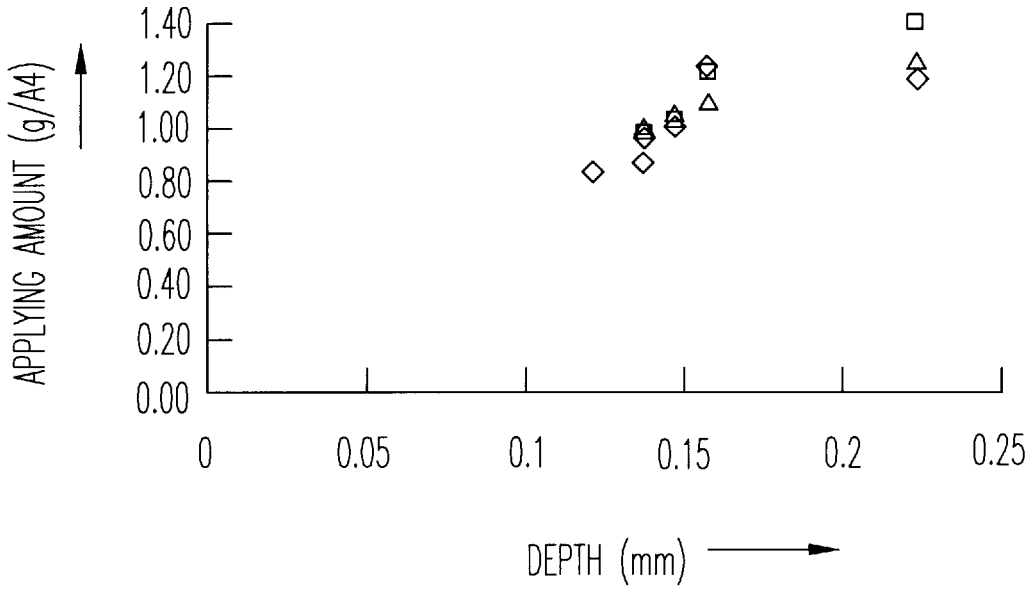
FIG. 9 is a graph showing the relationship between the depth of the applying roller's recess portion and the amount of applied liquid.

FIG. 9 is a graph illustrating a relationship between a depth d (mm) of the recess portions 23 in the form of quadrangular pyramids formed on the applying roller 23 and an applying amount (9/A4) 6f the unstabilizing liquid, where data indicated by symbols ◇, □, and Δ in the drawing represent values obtained by setting a circumferential speed (mm/sec) of the applying roller 23 to 25, 40, and 50 mm/sec, respectively. The pitch of the above recess portions 23*a* is set to 0.6 mm. Further, the unstabilizing liquid 21 used here is made by mixing 1 wt % of a surface active agent AOT (aerosol OT) and 1 wt. % of S113 in water, and a conveying speed of the transfer paper is set to the same value as the linear speed of the applying roller 23.

As is apparent from the graph in FIG. 9, it can be easily understood that, the deeper the depth d the recess portion becomes, in other words, the larger the capacity of the recess portions (the capacity of the space enclosed by the side surfaces of the recess portions and the circular circumferential surface thereof) becomes, the more amount of the unstabilizing liquid tends to be applied to the transfer paper.

Figure 10A:
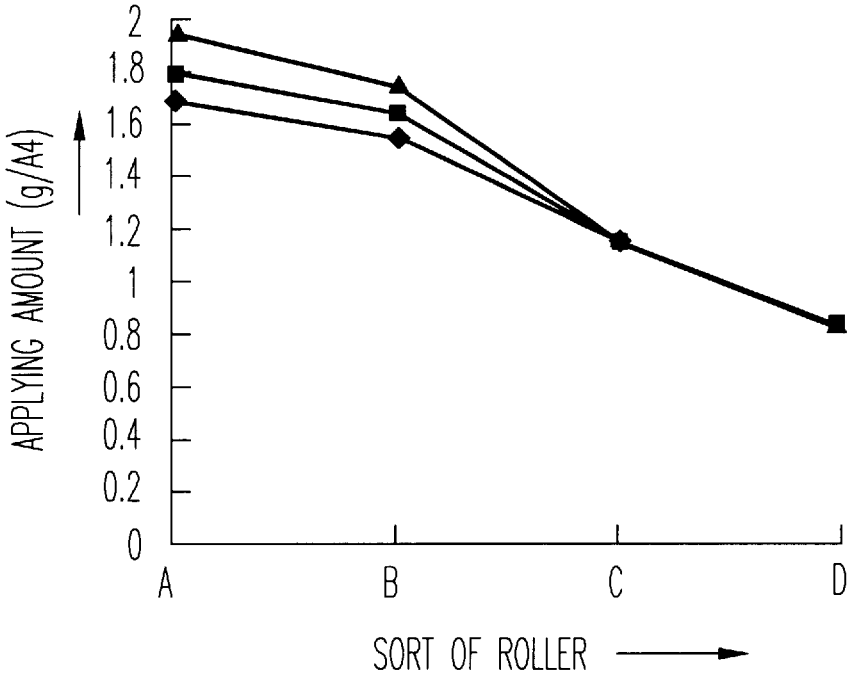
FIGS. 10*a* and 10*b* are graphs showing the relationship between the sort of applying roller and the amount of applied liquid.
Figure 10B:
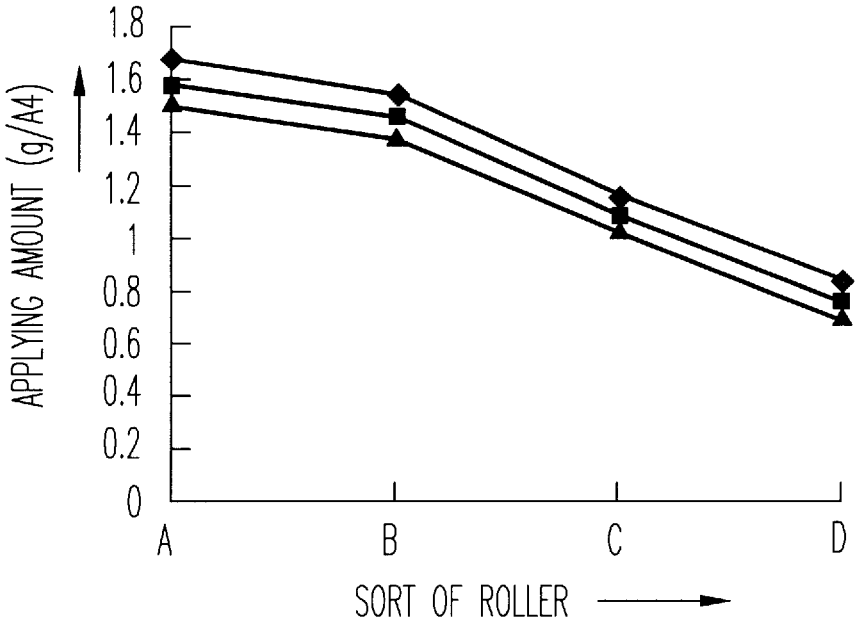

FIGS. 10*a* and 10*b* are graphs showing the differences between the liquid applying amounts to various applying rollers. In this drawing, A, B, C, and D in the (axis of) abscissa represent an applying roller having 0.6 mm of the pitch p and 0.223 mm of the depth d, an applying roller having 0.6 mm of the pitch and 0.156 mm of the depth d, an applying roller having 0.6 mm of the pitch p and 0.12 mm of the depth d, and an applying roller having 0.4 mm of the pitch p and 0.1 mm of the depth d, respectively. The unstabilizing liquid 21 used here is made by mixing 10 wt % of a surface active agent AOT (aerosol OT) and 10 wt % of D (methylentanediol) in water (surface tension=approx. 40 dyne/cm), and a conveying speed of the transfer paper is set to the same value as the linear speed of the applying roller 23. In addition, data indicated by symbols ◆, ■, and ▲ in FIG. 10*a* represent values obtained by setting a circumferential speed of the applying roller 23 to 25 mm/sec and using transfer paper "T6200 (trademark)," "Shigen (trademark)," and "My Paper (trademark)" made by Ricoh, respectively. Further, data indicated by symbols ◆, ■, and ▲ in FIG. 10*b* represent values obtained by using transfer paper "T6200 (trademark)" made by Ricoh and setting the circumferential speed of the applying roller 23 to 25, 40, and 50 mm/sec, respectively.

As is apparent from the graphs shown in FIGS. 10*a* and 10*b*, it can be easily understood that, although there exist differences in the sort of the transfer paper and in the circumferential speed of the applying roller, the larger the capacity of the recess portion formed on the circumferential surface of the applying roller 23 (the capacity of the space enclosed by the side surfaces of the recess portions and the circular circumferential surface) becomes, the more amount of the unstabilizing liquid tends to be applied to the transfer paper.

As is apparent from the foregoing descriptions of the embodiments/modification according to the present invention, some merits or advantageously functional effects can be found out.

According to the first invention, assuming that the shape and size of the recess portion of the liquid applying member are previously set so as to enable to hold the unstabilizing liquid of the amount necessary for reproducing the image carrier, even though the circumferential speed of the liquid applying member is equal to the speed of transporting the image carrier, it is possible to stably apply a necessary amount of the unstabilizing liquid to the image carrier by use of the liquid applying member.

Furthermore, since the respective recess portions on the above-mentioned liquid applying member are formed independently from each other, there arises no fear that the unstabilizing liquid held once does not flow down along the groove before applying the liquid as in the case of forming a continuous groove such as a spiral groove, a mesh-state groove, etc. Consequently, contrary to the case of employing a liquid applying member having a sponge-like surface portion, a liquid applying member having a pear-skin processed surface, or a liquid applying member having a continuous groove formed on the surface thereof such as a spiral groove, a mesh-state groove, or the like, the invention can expect a functional effect of stably applying the necessary amount of unstabilizing liquid for producing the image to the image carrier without making the circumferential speed greater than the speed of transporting the image carrier.

According to the second invention, a tool or instrument having a projecting portion formed thereon so as to engage with a recess portion of a target shape to be formed on the circular circumferential surface of a roller-state member and made of a substance harder than that of the surface portion of the liquid applying member is pressurizedly pressed to the roller-state raw material of the liquid applying member, and the raw material or the tool is rotated. In such a situation, the projecting portion of the tool eats (cuts) into the surface of the raw material, and thereby the aforementioned recess portion is formed thereon.

Consequently, compared with the conventional method of forming the recess portion by use of etching, the procedure of mechanical processing becomes simple and the cost of processing is reduced. Furthermore, the management of the recess portion's shape is simple, and the work of processing does not require any special skill or know-how of the worker.

According to the third invention, when the above-mentioned tool or instrument is pressurizedly pressed to the roller-state raw material of the liquid applying member and the raw material or the tool is rotated, the projecting portion of the tool eats into the surface of the raw material in a state of pressurizedly pressing the circular circumferential surface remaining on the surface of the tool to the outer circumferential surface of the raw material, and thereby the recess portion is formed on the outer circumferential surface of the raw material.

Consequently, any changed portion is not formed on the outer circumferential surface of the raw material and the outer circumferential surface of uniform diameter can be obtained, and thereby the recess portion of suitable aimed shape can be formed on the roller-state raw material of the liquid applying member.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An apparatus for removing an image forming substance from an image carrier comprising:

an unstabilizing liquid supplying unit formed with a portion in a liquid container containing unstabilizing liquid for directly applying said unstabilizing liquid to said image carrier;

a toner peeling-off unit for receiving said image carrier from said unstabilizing liquid supplying unit and for peeling off toner attached to an image area on said image carrier and sending out the image carrier; and a drying unit for drying said image carrier sent out from said toner peeling-off unit;

wherein:

said unstabilizing liquid supplying unit includes a liquid applying member formed as a roller for applying said unstabilizing liquid onto the image carrier having the image formed on a surface of said image carrier made of said image forming substance;

said unstabilizing liquid is applied onto said image carrier for the purpose of making unstable an attaching state between said image forming substance and said image carrier; and a large number of recess portions independent from each other are provided on a circular circumferential surface of said liquid applying member.

2. The apparatus as defined in claim 1, wherein said unstabilizing liquid supplying unit further includes:

an image carrier transporting roller for transporting said image carrier applied with said unstabilizing liquid.

3. A method of applying an unstabilizing liquid to an image carrier, the method comprising the steps of:

providing a liquid applying member formed with a portion in a liquid container containing an unstabilizing liquid in a state of a roller for directly applying said unstabilizing liquid onto said image carrier having an image formed on a surface thereof made of an image forming substance;

applying said unstabilizing liquid onto said image carrier for making unstable an attaching state between said image forming substance and said image carrier; and peeling off thereby said image forming substance from said image carrier;

wherein a large number of recess portions independent from each other are provided on a circular circumferential surface of said liquid applying member.

4. A method for removing an image forming substance from an image carrier comprising the steps of:

applying an unstabilizing liquid to said image carrier by use of an unstabilizing liquid supplying unit;

peeling off toner attached to an image area on said image carrier and sending out the image carrier by use of a toner peeling-off unit; and drying said image carrier sent out from said toner peeling-off unit;

wherein:

said unstabilizing liquid supplying unit includes a liquid applying member formed in a state of a roller with a portion in a liquid container containing said unstabilizing liquid for directly applying said unstabilizing liquid onto the image carrier having the image formed on a surface of said image carrier made of an image forming substance;

said unstabilizing liquid is applied onto said image carrier for the making unstable an attaching state between said image forming substance and said image carrier; and a large number of recess portions independent from each other are provided on a circular circumferential surface of said liquid applying member.

5. A method of reproducing an image carrier as defined in claim 4, wherein said unstabilizing liquid supplying unit further includes:

an image carrier transporting roller for transporting said image carrier applied with said unstabilizing liquid.

6. An image carrier reusing apparatus for removing an image forming substance formed on an image recording medium and enabling to reuse said image carrier comprising:

a liquid applying member for applying liquid to an image recording medium; and an image forming substance removing member for removing the image forming substance from said image recording medium, wherein said liquid applying member is formed in a state of a roller with a portion in a liquid container containing unstabilizing liquid for directly applying said unstabilizing liquid onto said image recording medium having an image formed on a surface of said image recording medium made of said image forming substance, wherein said unstabilizing liquid is applied onto said image carrier to make an attaching state between said image forming substance and said image recording medium unstable;

wherein a large number of recess portions independent from each other are provided on a circular circumferential surface of said liquid applying member;

wherein said image forming substance removing member is located downstream in a image recording medium transporting direction of said liquid applying member; and wherein the image forming substance formed on said image recording medium, to which the liquid is applied by said liquid applying member, is removed.

7. An apparatus for removing an image forming substance from an image carrier comprising:

an unstabilizing liquid supplying unit for applying an unstabilizing liquid to said image carrier;

a toner peeling-off unit for peeling off toner attached to an image area on said image carrier and sending out the image carrier; and a drying unit for drying said image carrier sent out from said toner peeling-off unit;

wherein:

said unstabilizing liquid supplying unit includes a liquid applying member formed as a roller for applying an unstabilizing liquid onto the image carrier having the image formed on a surface of said image carrier made of said image forming substance;

said unstabilizing liquid is applied onto said image carrier for the purpose of making unstable an attaching state between said image forming substance and said image carrier; and a large number of recess portions independent from each other are provided on a circular circumferential surface of said liquid applying member; and wherein said toner peeling-off unit includes:

a heating roller containing a heating lam employed as a heating medium;

a pressing roller containing another heating lamp employed as a grasping medium;

a plurality of belt supporting rollers;

a toner offset belt employed as a toner peeling-off medium having a form of a belt suspended around said heating roller and said plurality of belt supporting rollers; and a rotation brush roller for removing toner from a surface of said offset belt.

8. The apparatus as defined in claim 7, wherein said unstabilizing liquid supplying unit further includes:

a liquid container for containing unstabilizing liquid; and an image carrier transporting roller for transporting said image carrier applied with said unstabilizing liquid.

9. An apparatus for reproducing an image forming substance from an image carrier comprising:

an unstabilizing liquid supplying unit for applying an unstabilizing liquid to said image carrier;

a toner peeling-off unit for peeling off toner attached to an image area on said image carrier and sending out the image carrier; and a drying unit for drying said image carrier sent out from said toner peeling-off unit;

wherein:

said unstabilizing liquid supplying unit includes a liquid applying member formed as a roller for applying an unstabilizing liquid onto the image carrier having the image formed on a surface of said image carrier made of said image forming substance;

said unstabilizing liquid is applied onto said image carrier for the purpose of making unstable an attaching state between said image forming substance and said image carrier; and a large number of recess portions independent from each other are provided on a circular circumferential surface of said liquid applying member; and wherein said drying unit for drying said image carrier sent out from said toner peeling-off unit includes:

a heating drum containing a heating lamp, a plurality of supporting rollers; and a pressing belt for pressing said image carrier which is suspended around said plurality of supporting rollers.

10. The apparatus as defined in claim 9, wherein said unstabilizing liquid supplying unit further includes:

a liquid container for containing unstabilizing liquid; and an image carrier transporting roller for transporting said image carrier applied with said unstabilizing liquid.

* * * * *